US006716042B2

(12) United States Patent
Lin

(10) Patent No.: US 6,716,042 B2
(45) Date of Patent: Apr. 6, 2004

(54) TRACK SYSTEM OF PROJECTOR LAMP AND ELECTRICAL CONNECTION DEVICE ASSEMBLY THEREOF

(76) Inventor: Michael Lin, 8F., No. 659, Chung Cheng Rd., Hsinchuang, Taipei Hsien (TW)

( * ) Notice: Subject to any disclaimer, the term of this patent is extended or adjusted under 35 U.S.C. 154(b) by 0 days.

(21) Appl. No.: 10/188,848

(22) Filed: Jul. 5, 2002

(65) Prior Publication Data

US 2004/0005798 A1 Jan. 8, 2004

(51) Int. Cl.[7] ..... H01R 25/00; F21S 8/00
(52) U.S. Cl. ..... 439/110; 362/147
(58) Field of Search ..... 439/110, 115, 439/119, 120, 121; 362/147, 148, 150, 153, 391

(56) References Cited

U.S. PATENT DOCUMENTS 5,833,358 A * 11/1998 Patik ..... 362/391
6,022,129 A * 2/2000 Tang ..... 362/404
6,231,205 B1 * 5/2001 Slesinger et al. ..... 362/133
6,244,733 B1 * 6/2001 Fong et al. ..... 362/391
6,540,372 B2 * 4/2003 Joseph ..... 362/147

* cited by examiner

*Primary Examiner*—Michael C. Zarroli
(74) *Attorney, Agent, or Firm*—Troxell Law Offices PLLC

(57) ABSTRACT

A track system of projector lamp and electrical connection device assembly thereof, particularly a track for projector lamp of 230V or higher voltage and its electrical connection device, having two longitudinal end sides respectively providing a set of power supply circuit connection system under a same track structure, respectively controlling power on/off, forming a composite electrical connection space and environment, facilitating more projector lamps to select, by means of electrical insert plates of electrical connection device, power supply circuit connection systems and same or different on/off control groups for electrical connection on the track system, to obtain on/off control of selected projector lamps on the track, which is different from a regular single track power supply circuit for merely full on or full off control.

29 Claims, 13 Drawing Sheets

TRACK SYSTEM OF PROJECTOR LAMP AND ELECTRICAL CONNECTION DEVICE ASSEMBLY THEREOF

BACKGROUND OF THE INVENTION

Track projector lamps are widely used in residences or commercial environment for illumination purposes, because of their features of convenience and cost reduction when several projector lamps can be simultaneously turned on a power supply track to suit the position or objects that require illumination under a power supply track system with electrical connection; however, the track structure used in a conventional track projector lamp belong to a straight-line rigid track construction, but under the modernized architectural design and interior decoration that places emphasis on softened lines and arched wall spaces, such straight-line rigid track structure appears to be not so ideal in installation. Therefore, the industry has developed different power supply track systems with flexible rails, to suit the shapes of indoor walls and spaces, with the equipment of electrical connection device, for illumination purposes using a plurality of projector lamps in a connected track such as the power supply track structures used in U.S. Pat. Nos. 6,022,129, 6,244,733B1, 5,833,358 and Taiwanese patent No. 161268. Those track structures are applicable to the assembly of track projector lamps of low-voltage or 230V power supply.

In such track structures disclosed in the U.S. Pat. Nos. 6,022,129 and 6,244,733B1, two flattened electrodes and an insulating unit consist a track and power supply circuit system, or U.S. Pat. No. 583,358 that discloses a conductive member embedded in two sides under a framed structure, composing a bendable track and power supply circuit system, or the Taiwanese patent No. 161268 that discloses a track and power supply circuit system consisting of two framed metal polarity tracks and an insulating unit; such power supply track systems can only connect and control a plurality of projector lamps by electrical connection of a single power supply circuit system. The electrical connection device has a clip type electrode device to correspond to the track for clamped connection, and requires nuts and other parts for tightening purposes, so that the assembling is not so convenient, and possible dropping in case of poor installation, as for such structure in actual use and requirements, particularly when the position or objects to be lighted need not necessarily be lighted at the same time, particularly the exhibition atmosphere or requiring lighting angles, or in a shopping window outside of business hours, or the indoor does not need so many projector lamps being turned on, only a single track structure of power supply circuit system could not achieve selective quantity or location of on or off of the lighting fixture for the plurality of track lamps on the power supply circuit system, only two options of either wholly turned on or wholly tuned off; except adopting multiple tracks and power supply circuit systems for respective installation of track lamps can achieve that purpose. But the parallel installation of such multiple tracks involves relatively increased costs and space, however, under interior design there will not necessarily be such space for installation, resulting in difficulty and inconvenience in installation.

As for the projector lamp track of 230V or a higher voltage, there are similarities between the structures with low-voltage tracks, with only an additional grounding terminal or a grounding strip for assembly of an electrical connection device, therefore, it has the same problems and difficulties as the aforementioned low-voltage track structures.

Regarding the inventor's Utility model patent File No. 90216688, which was allowable by Taiwan IPO, the track structure in that case has provided projector lamps assembled with double power supply circuits, but that track structure is applicable only to low-voltage track and projector lamps, which could not be sued for assembly or use of projector lamps of 230V voltage or above. The electrical connection device involves clamped type electrode plates that are clamped for connection by corresponding tracks, and need tightening nuts or other components for tightening and positioning purposes, so that the assembly is not so inconvenient or in case of careless dropping during the assembling process, resulting in the necessity of coming down from a ladder to pick up or locate missing items, as well as other difficulties.

SUMMARY OF THE INVENTION

The present invention of track system for projector lamps and electrical connection device assembly, the track system can be installed on a ceiling or a wall surface by the installation of a locator, on two sides of the track seat being a plurality of track grooves, in combination with a common electrode end, respectively forming a power supply circuit connection system on two longitudinal track seat ends, obtaining at least two sets of composite power system circuit connection systems under the single track structure environment, forming a composite electrical connection space and environment, enabling selective installation of more projector lamps; the electrical connection device installed at an end of the projector lamp has a pair of electrical insert plates at an end of connection, in coordination with a grounding electrode, under the auxiliary positioning of the fastening groove installed at the corresponding track, providing selective power supply circuit connection system for electrical connection with corresponding track system for easy installation, enabling a plurality of projector lamps assembled under a single track system structure, to obtain respective or simultaneous on/off control of projector lamps.

DETAILED DESCRIPTION OF PREFERRED EMBODIMENTS

Figure 1:
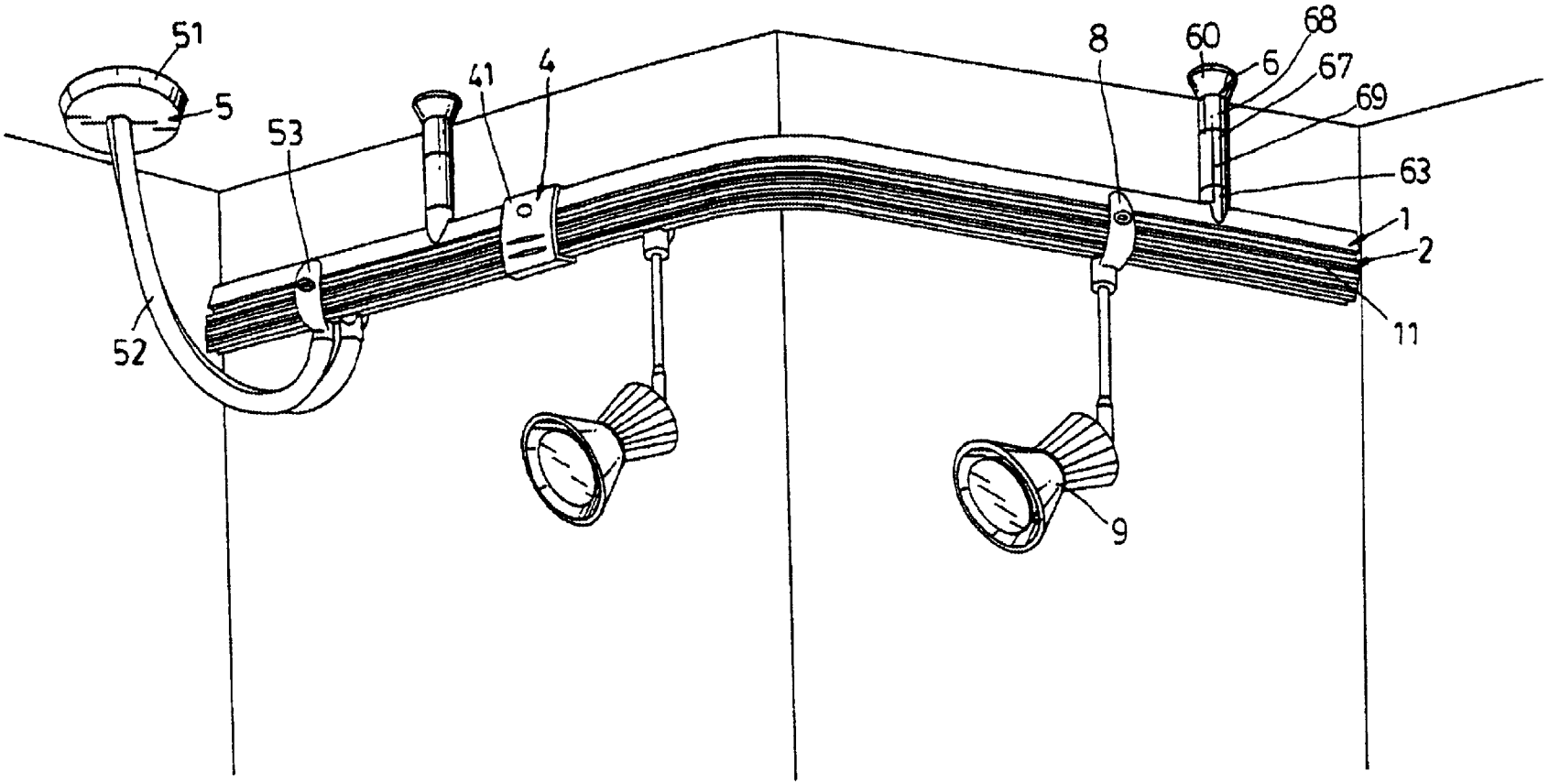
FIG. 1 is a perspective view of a preferred embodiment of the invention of projector lamp installation.
Figure 2:
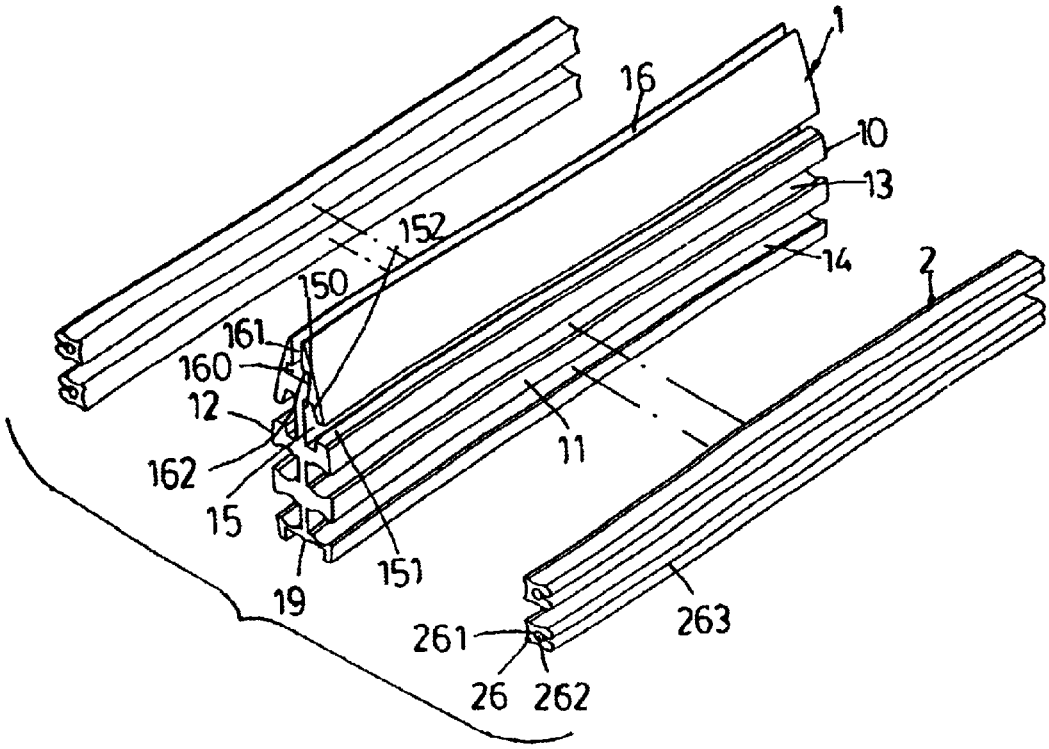
FIG. 2 is an exploded view of the track unit in the preferred embodiment of the invention
Figure 3:
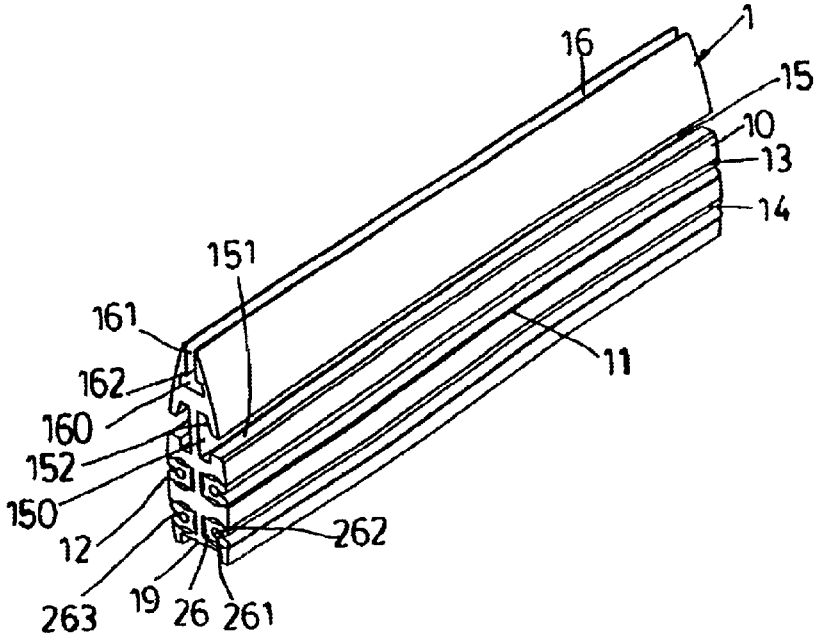
FIG. 3 is an assembled perspective view of the preferred embodiment of the invention.

Please refer to FIG. 1 that illustrates a preferred embodiment of the present invention of projector lamp track system and electrical connection assembly. As shown in the drawing the construction of the embodiment comprises a track unit 1 that is bendable to suit requirements of environment where it is installed. The track unit 1 can be extended by an extension member 4 to a length as required for the installation. The track unit 1 provides two composite power supply circuit connecting systems 11, 12 and an electrical connection assembly environment, at least one set of power supply set 5 corresponding to power supply required for electrical circuit connection supply and electrical connection to control unit for on-off control. As for the installation of the track unit 1, a specified number of locators 6 are hanged and positioned on a ceiling or a wall surface; most projector lamps 9 ca be optionally connected to different positions of the circuit connecting systems 11, 12 provided by the track unit 1, subject to on or off or simultaneous on/off controls by the on/off control modules defined by the electrical circuit; wherein:

As shown in FIGS. 2 and 3, the track unit 1 comprises a track seat 10 as its main unit. The bottom of the track seat 10 is defined as a joint electrode end 19 for grounding purpose. The bottom of the track seat 10 of the joint electrode end 19 is adopted as a level bottom, or a depressed bottom (as shown in FIGS. 2 and 3), to provide the function of engagement when a grounding electrode 88 corresponds to an electrical connection device 8, enabling secure installation and electrical connection of the projector lamp 9. On two longitudinal sides of the track seat 10 are respectively a first power supply circuit connection system 11 and a second power supply circuit connection system 12. These systems 11, 12 are opposite each other and assembled respectively on a half side of the track seat 10, and respectively consist of two track grooves 13, 14 and an engaging groove 15, with the joint electrode end 19. Meanwhile, embedded and fixed in each track groove 13, 14 is an electrode set 2, providing electrical connection for the electrical connection device 8, and is engaged in the engaging groove 15 for the assembly and positioning of the projector lamp and for power supply. At an upper end of the track seat 10 is a mounting groove 16, enabling a locator 4 to fasten the track unit 1 onto a ceiling or a wall surface. The mounting groove 16 is preferably shaped to have a width of groove bottom 160 larger than the groove channel 16, forming a reverse stop shoulder 162, and preferably shaped as a reversed "T".

The track seat 10 is preferably shaped like but not limited to an elongated track rail, and preferably having electrical conductivity. Recommended materials include copper, iron, aluminum, silver or other conductive metal material; or materials plated with gold, copper, iron, aluminum or silver; or other conductive metal materials, and preferably made of extruded aluminum material, so as to have proper grounding function and reduce the weight and cost of the track unit 1;

The engaging groove 15 in the first power supply circuit connecting system 11 and the second power supply circuit connecting system 12 is preferably shaped to have a width of the groove bottom 150 larger than the groove channel 15, and preferably has at least one side of reverse stop wall 152, and preferably shaped like a reversed "T" (shown in FIG. 3).

The electrode set 2 inside each track groove 13, 14 has an insulating member 26, which is made in an elongated shape of material with insulating properties (such as foam products or other insulating materials). The insulating member 26 provides an accommodating space 261 to assemble a conductive unit 262 for transmission of power source. This accommodating space 261 is adjoined by an opening with a side end of the insulating member 26. This opening 263 provides electrical connection to the electrical insert plates 85, 86 of the electrical connection device, and is smaller than the thickness of the electrical insert plates 85, 86, but preferably enough to allow its passage, to obtain appropriate clamping function.

Figure 4:
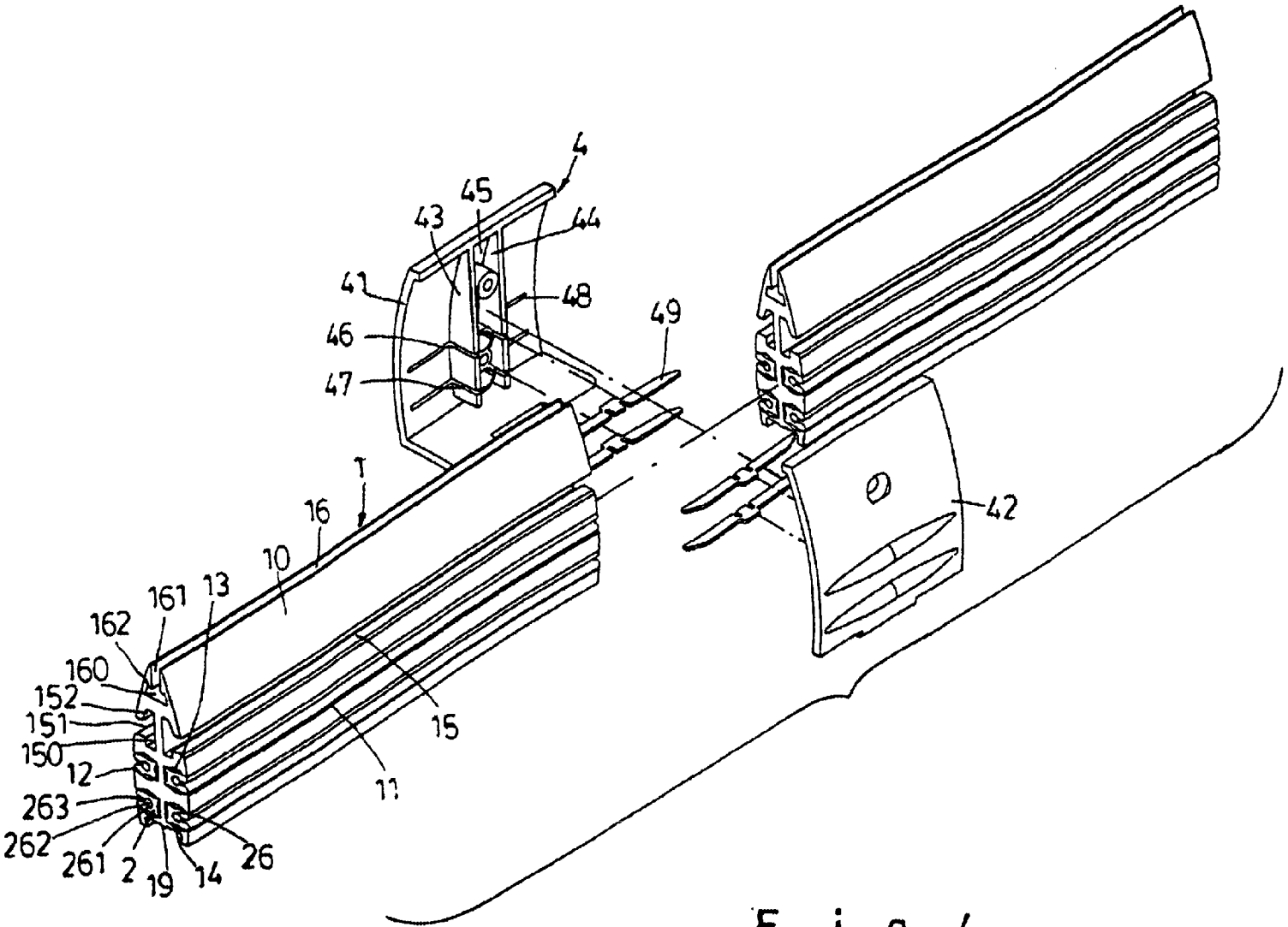
FIG. 4 is an exploded view of the track unit and the extension member of the preferred embodiment of the invention.
Figure 5:
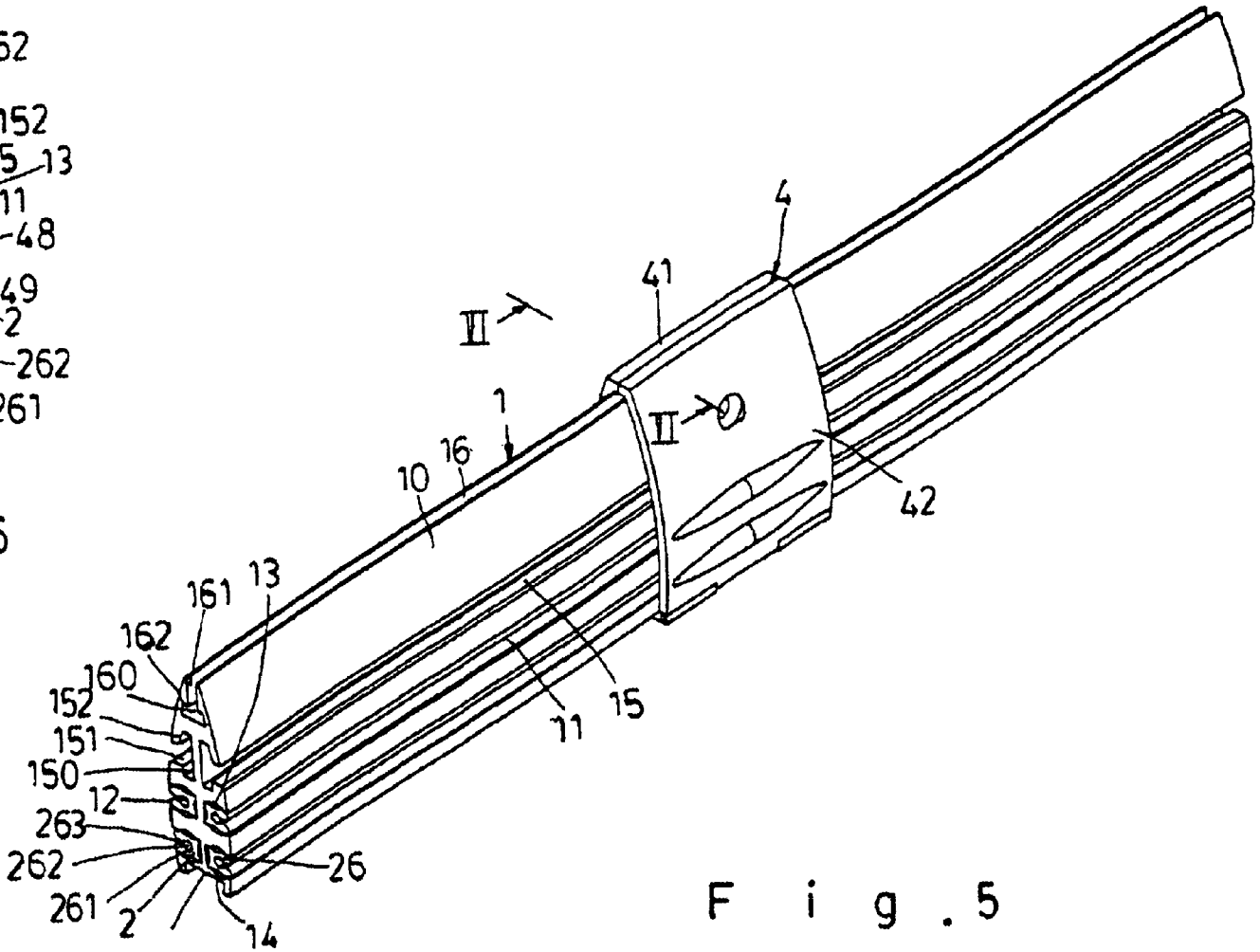
FIG. 5 is an assembled perspective view of the track unit and the extension member of the preferred embodiment of the invention.
Figure 6:
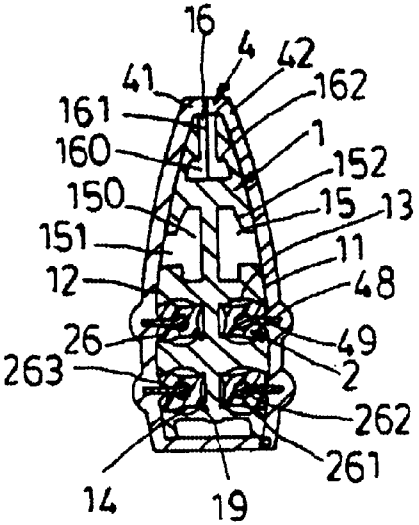
FIG. 6 is a section view of an assembly taken from line VI—VI in FIG. 5.

For considerations of production, storage and transportation, the track unit 1 has a limited single unit length, for actual requirements, and can be electrically extended by the extension member 4 to suit the required length for installation. The extension member 4, shown in FIGS. 4 through 6, comprises two oppositely assembled hemispheres 41, 42, which can be joined and assembled and tightened by screws onto the two track units 1 to be joined, serving as single coated type of extension and electrical connection (shown in FIG. 5). On an inside of the two hemispheres 41, 42 is a formation of parallel arrangement of two partitioning plates 43, 43. The partitioning plates 43, 44 set the depth of the track unit 1 penetrating the extension member 5 and the innermost side for assembly and positioning purposes. A space 45 between the two partitioning plates 43, 44 provide a space required for tightening the two hemispheres 41, 42. Meanwhile, between the ends of the two partitioning plates 43, 44, located at the top and the bottom, are two groove openings 46, 47. The distance between the groove openings 46, 47 is matching the distance between the track grooves 13, 14 of the track nit 1. An embedding groove 48 can be designed on the inside ends of the two hemispheres 41, 42, as required, to install a conductive plate 49 between neighboring embedding grooves 48 of respective groove openings 46, 47. The conductive plate 49 has an elongated shape. The thickness of the conductive plate 49 is equal to or slightly larger than the height of the opening 263 of the insulating member 26. The width of the conductive plate 49 is so designed that the conductive plate 49 can pass the opening 263 and enter the accommodating space 261 for electrical connection with the conductive unit 262. Thereby, while the extension member 4 is extended with coating with the two track units 1, the conductive plate 49 serves as a medium to provide electrical transmission between the two track units 1 (shown in FIG. 6).

Figure 7:
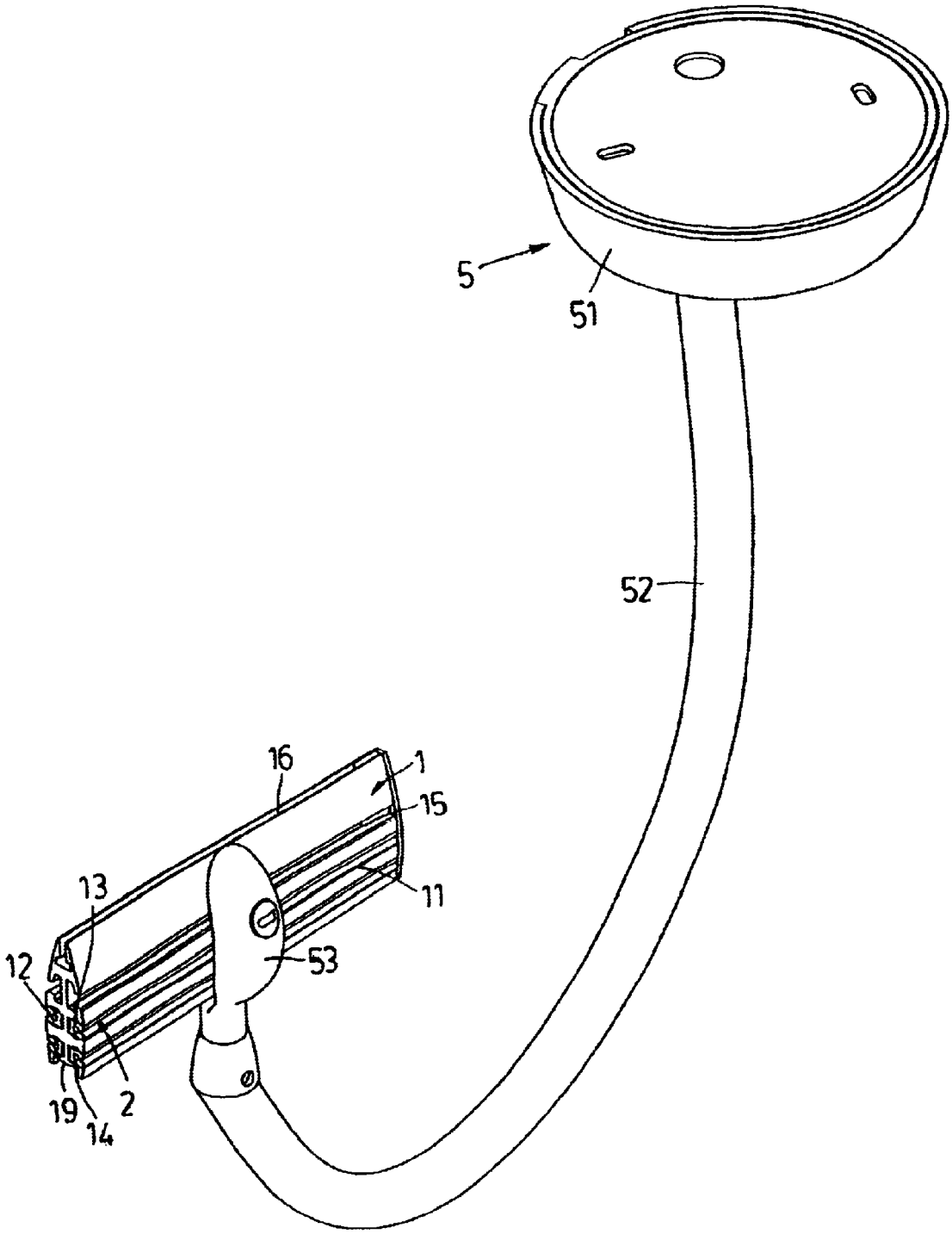
FIG. 7 is an assembled perspective view of the track unit and power supply set of the preferred embodiment of the invention.
Figure 8:
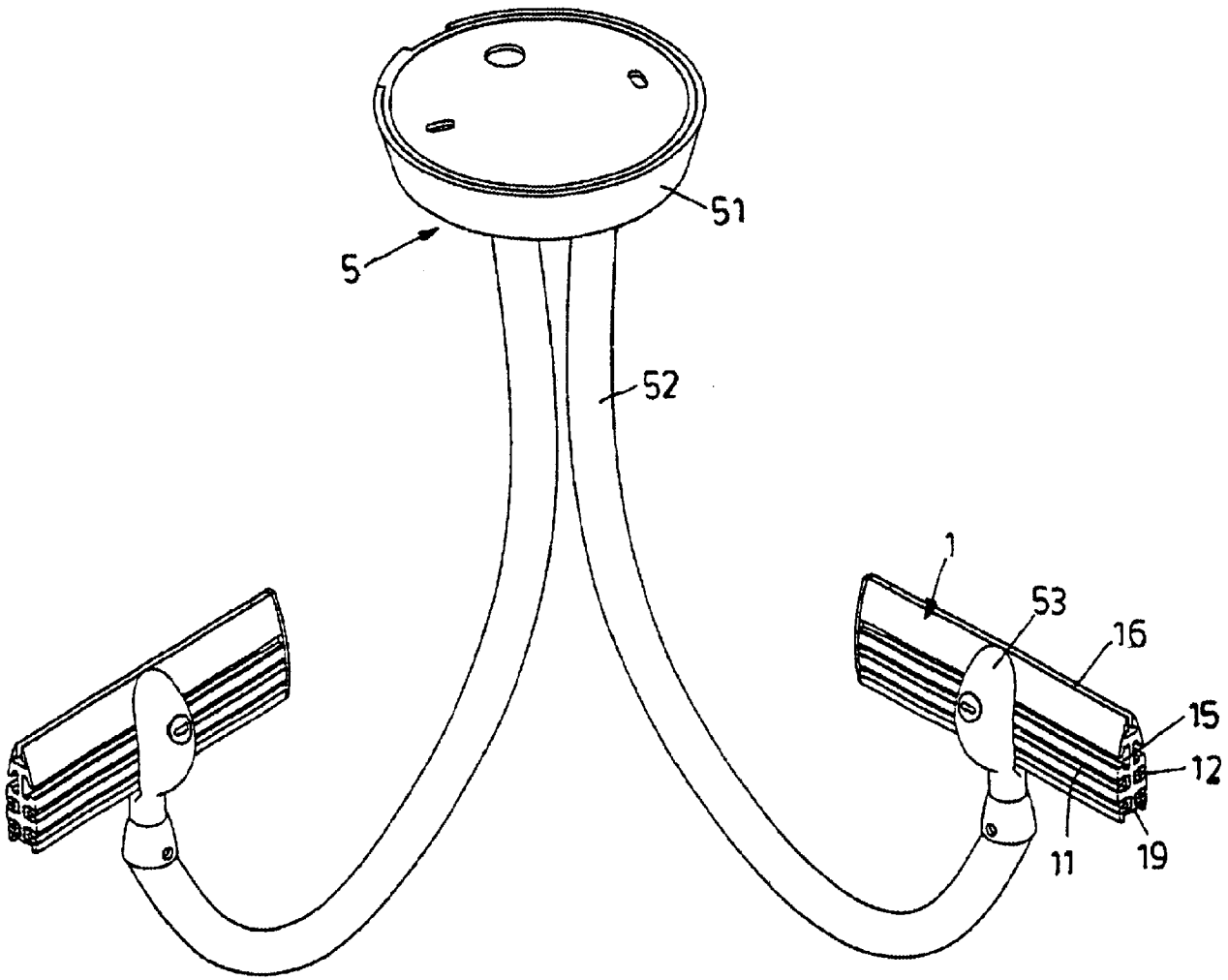
FIG. 8 is an assembled perspective view of another preferred embodiment of the track unit and power supply set of the invention.

The power supply of the track unit 1 in the first power supply circuit connection system 11 and the second power supply circuit connection system 12, which are respectively installed on two longitudinal ends of the track seat 10, comprises at least one set of power supply set 5 corresponding to two power supply circuit connection systems 11, 12 for electrical connection (shown in FIGS. 7 and 8), supplying required power and electrical connection to control member for on/off control. This power supply set S comprises a power disc 51 that is fastened to a ceiling or a wall surface in the neighborhood of the track unit 1, for electrical connection with indoor power supply cord to obtain power, and can be directly connected to or through indoor wiring connection to a control member (such as a switch) for on/off control. The quantity of control members can be the same as the quantity of the power supply circuit connection systems 11, 12 for respective connection and control. The power supply disc 51 is extension connected with at least one electrical connecting member 53 (shown in FIG. 7). In other words, in consideration of control and installation, two sets of power supply sets 5 can be adopted, respectively corresponding to one power supply circuit connecting system 11 or 12 for electrical connection. Of course, the two or more sets of electrical connecting members 53 can be installed, by means of the power supply disc 51, for simultaneous connection to two power supply circuit connecting systems 11, 12 of two or more track units 1 for electrical connection (shown in FIG. 8). The electrical connecting member 53 can be directly used with the electrical connecting device 8 installed at the end of the projector lamp 9, or other types of electrical connecting member, such as plug-shaped type, for direct insertion into the accommodating space 261 at the end of the track unit corresponding to the electrode set 2 of each track groove 13, 14, for electrical connection with the conductive unit 262.

Figure 9:
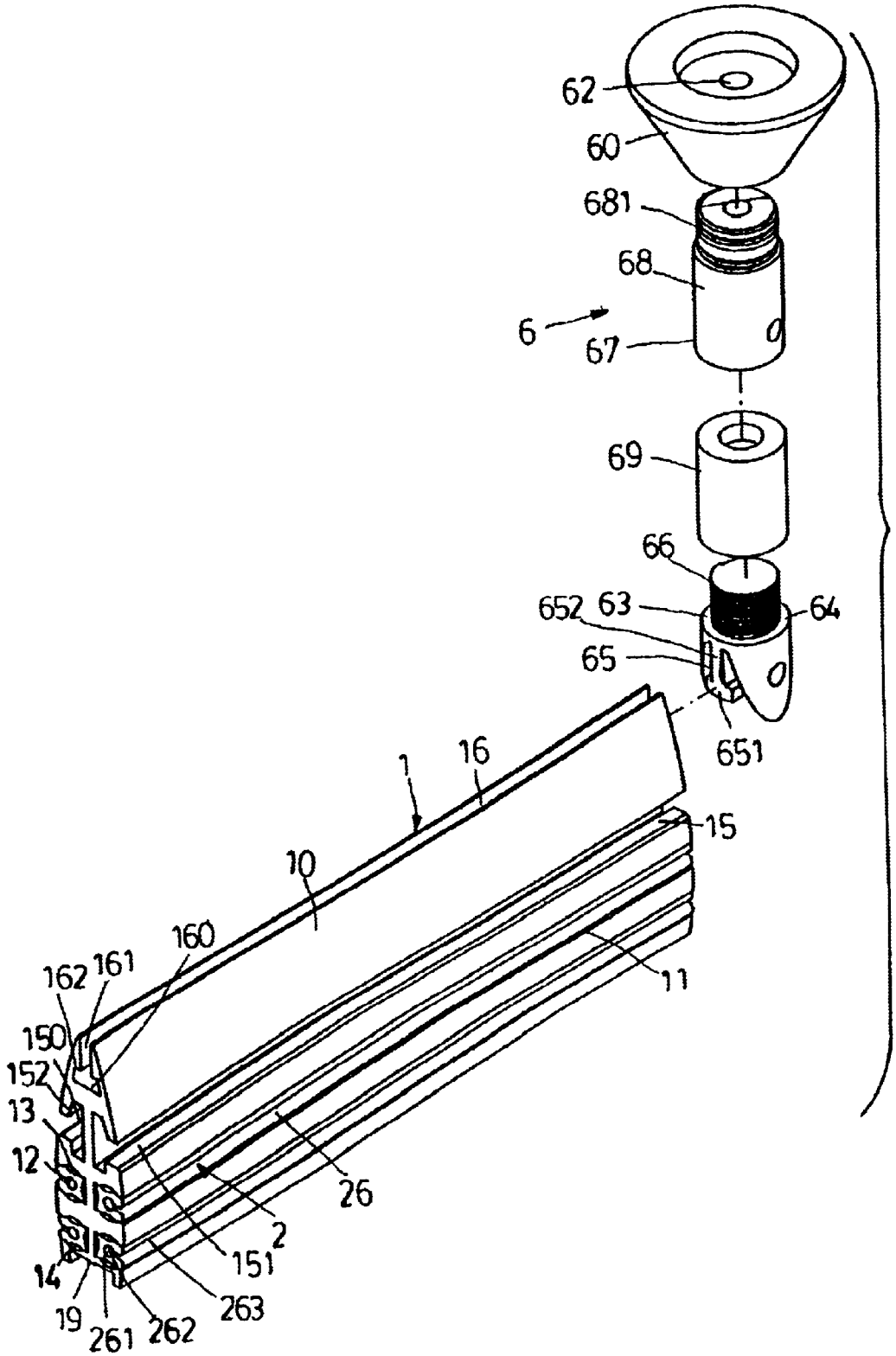
FIG. 9 is an exploded view of the track unit and locator in the embodiment of the invention.
Figure 10:
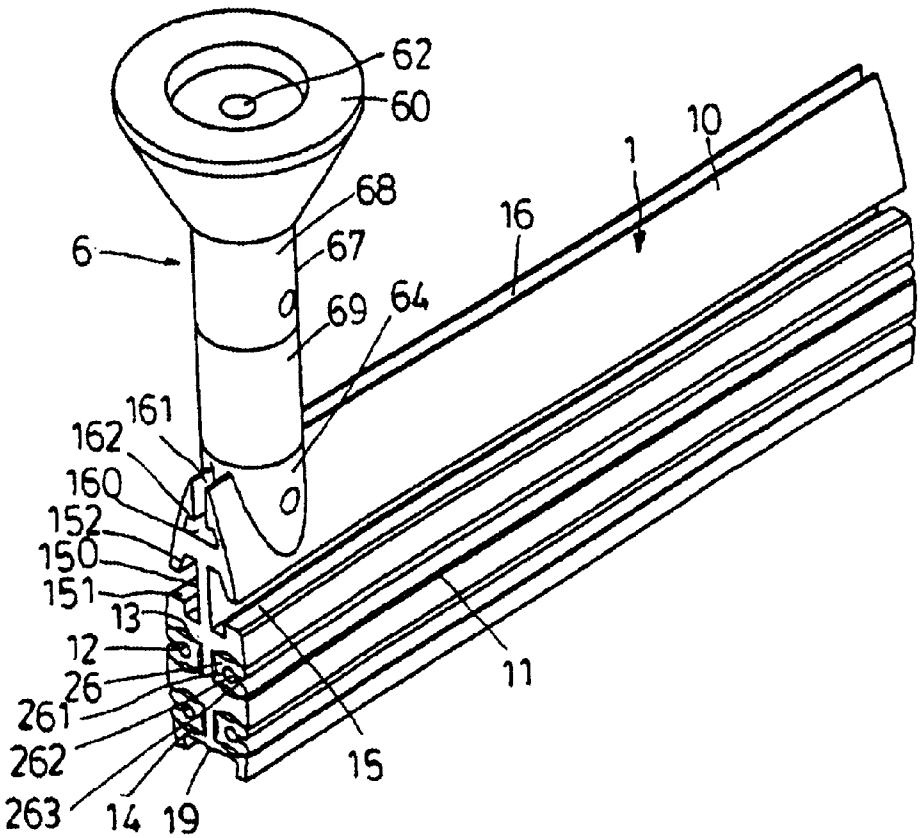
FIG. 10 is an assembled perspective view of the track nit and locator in the embodiment of the invention.
Figure 11:
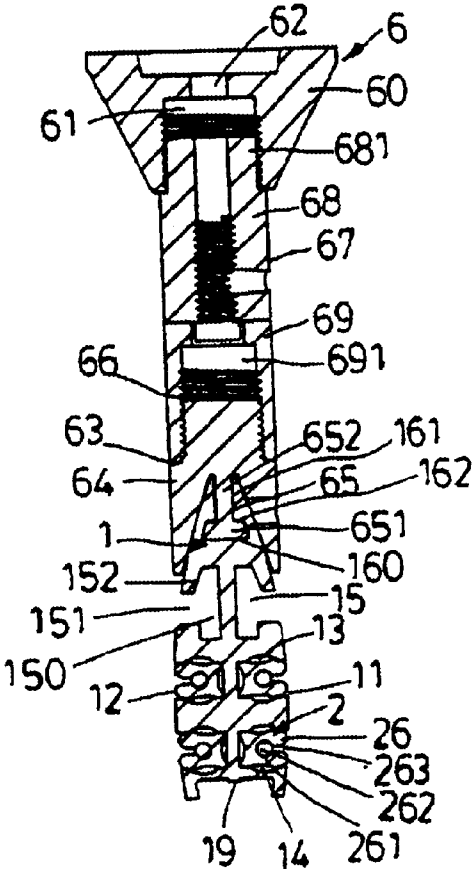
FIG. 11 is a section view of assembly of the track unit and locator in the preferred embodiment of the invention.
Figure 12:
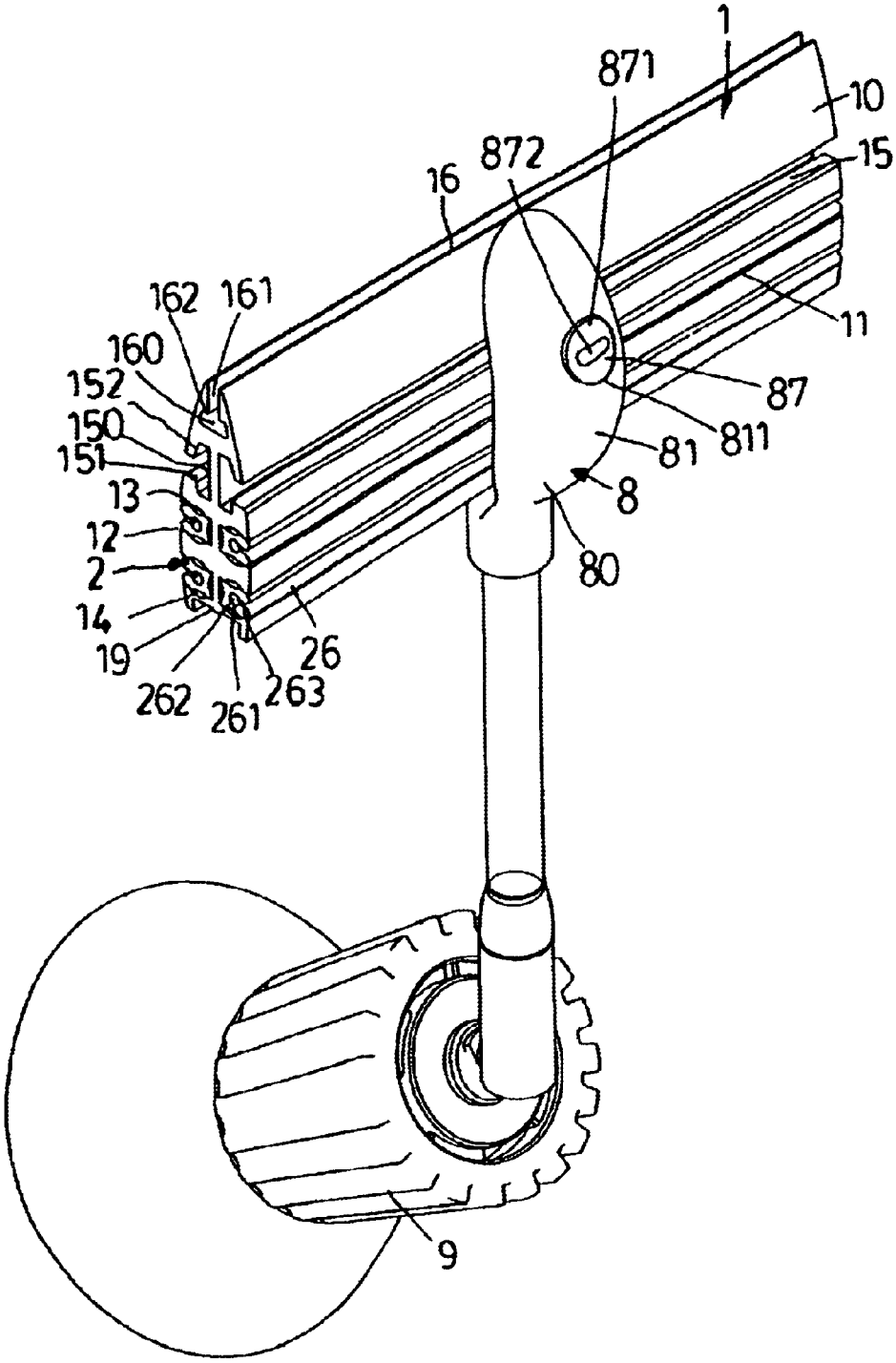
FIG. 12 is an assembled perspective view of the electrical connection device and the track unit of the invention.
Figure 13:
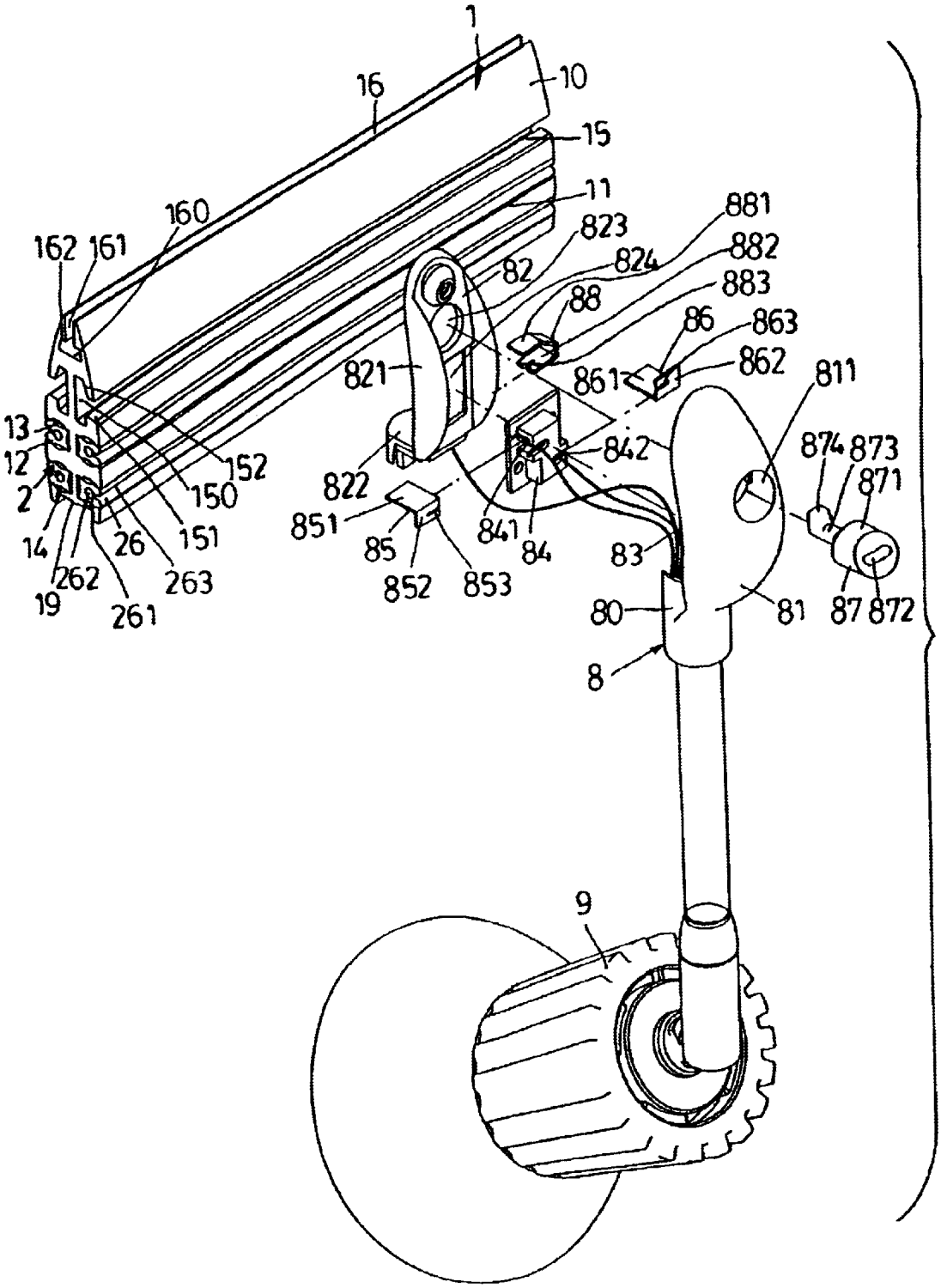
FIG. 13 is an exploded view of the electrical connection device and the track unit of the invention.
Figure 14:
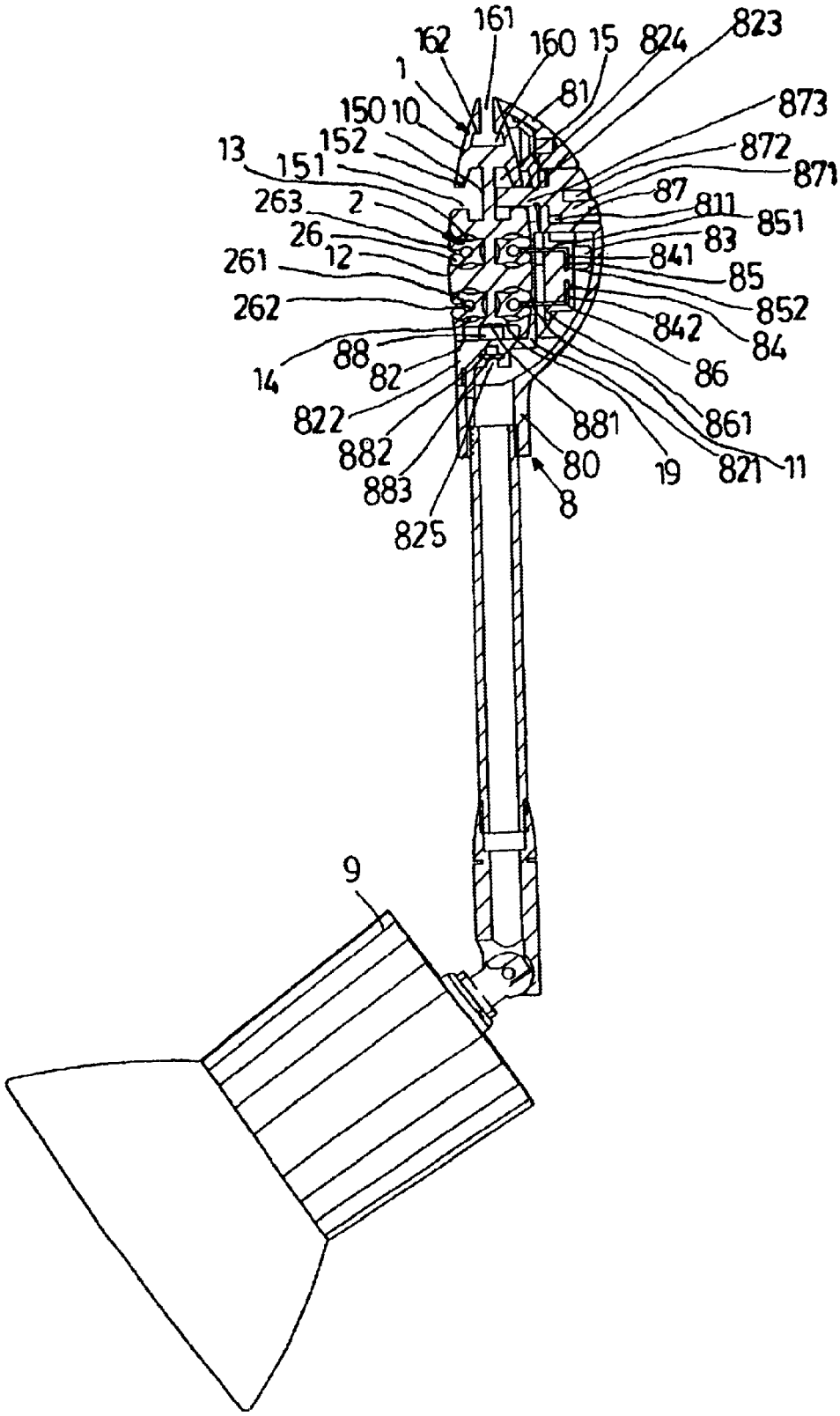
FIG. 14 is an assembled section view of the invention of electrical connection device and the first power supply circuit connection system in connection but not tightened.
Figure 15:
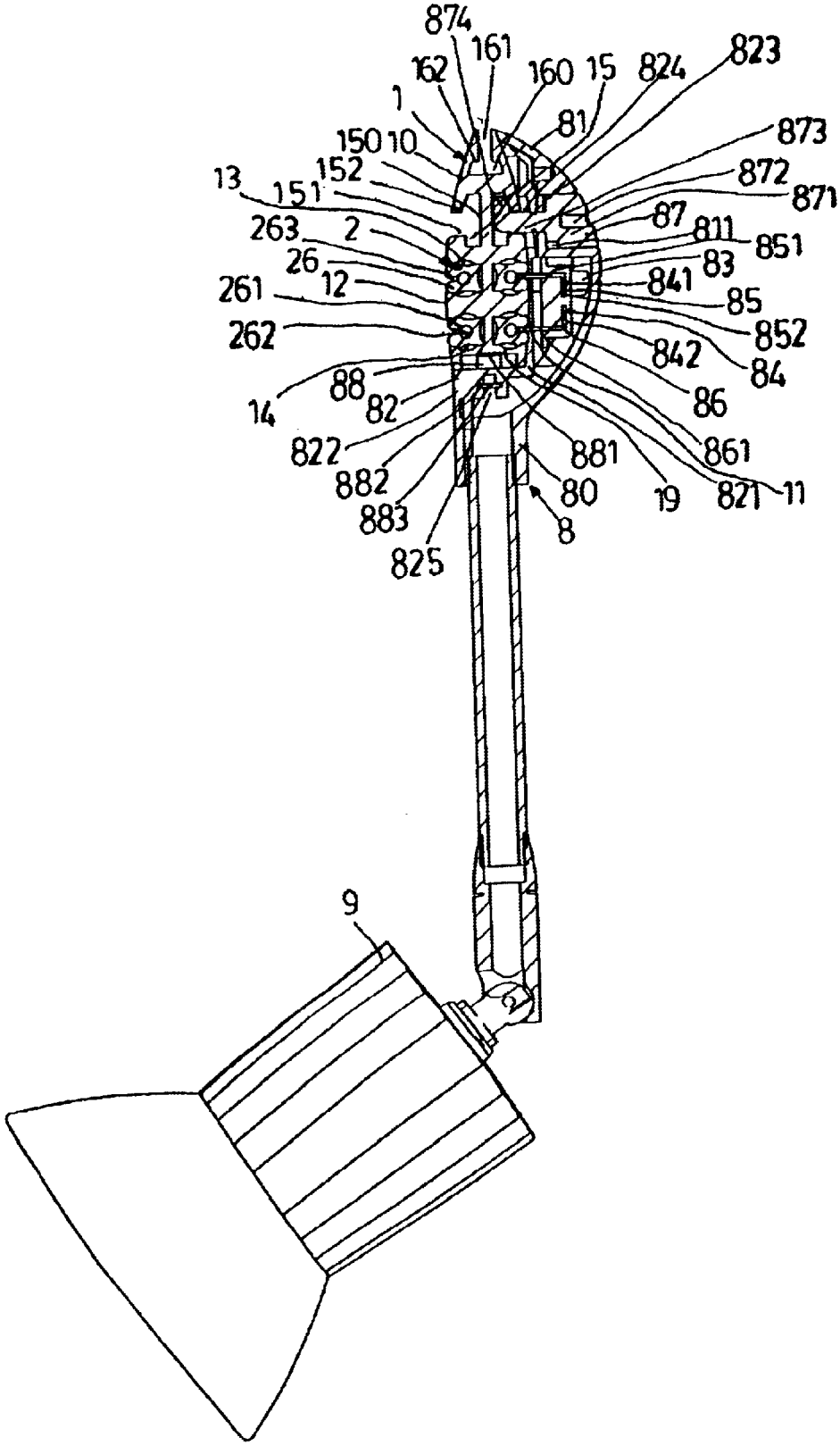
FIG. 15 is an assembled section view of the invention of electrical connection device and the first power supply circuit connection system in connection but tightened.
Figure 16:
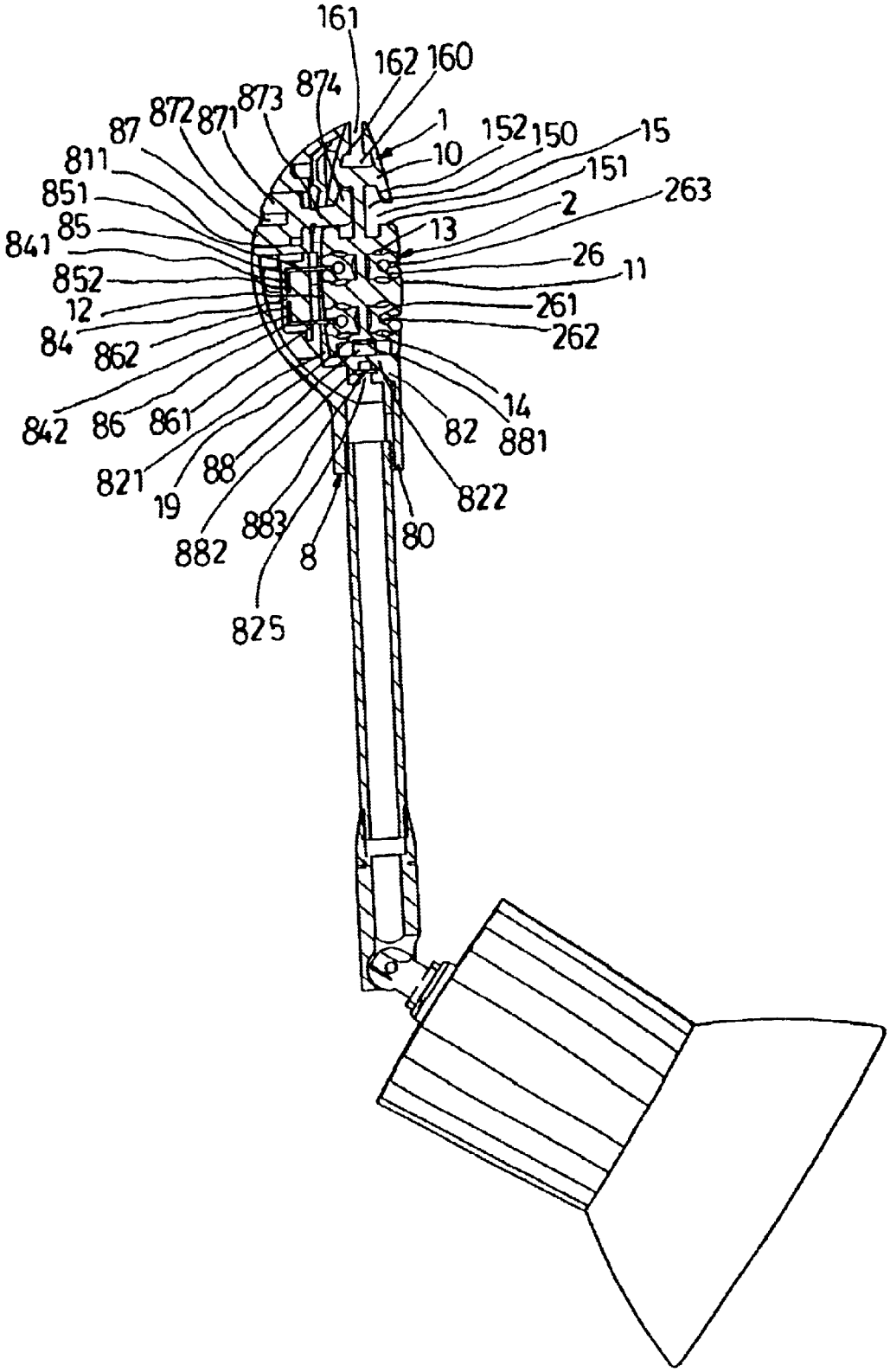
FIG. 16 is an assembled section view of the invention of electrical connection device and the second power supply circuit connection system in connection but tightened.

At least one locator 6, as shown in FIGS. 9 through 11, is used to position and assemble the track unit 1 to a ceiling or a wall surface. The assembly of the locator 6 comprises an upper tightening block 60, at the bottom side is a threaded tightening chamber 61 (shown in FIG. 9). Running upward is a through hole 62 for fixing a tightening member (such as screws or other fixing components) penetrating upward and tightened in position to match the position on the ceiling or the wall surface; a hanging member 63, having a base 64, at the bottom is an extension of a hanging post 65. The width of a post head 651 of the hanging post 65 is wider than a post wall 652, and is made in a shape symmetrical to the mounting groove 16 of the track unit 1, thereby the hanging post 65 is hanged and assembled to match the mounting groove 16 of the track unit 1 (shown in FIGS. 10 and 11). The upper part of the base 64 is shaped to have a connector 66 with a thread. The connector 66 has a diameter smaller than the diameter of the base 64 but equivalent to the inner diameter of the tightening chamber 61 of the upper tightening block 60, so it can directly match the tightening chamber 61 of the upper tightening block 60 and assemble the locator 6 to install the track unit 1; the total assembled length of the locator 6 can be extended by at least one set of extension assembly 67, to coordinate with the distance and height required from a ceiling or a wall surface when the track unit 1 is installed. This extension assembly 67 consists of an upper assembling block 68 and a lower assembling block 69 that are tightened by screws. Wherein, the upper end of the upper assembling block 68 is shaped to have a threaded tightening chamber 681, for assembly corresponding to the tightening chamber 61 of the upper tightening block 60. At the bottom of the lower assembling block 69 is a threaded tightening chamber 691, for tightening and assembly of the connector 55 of the hanging member 63 (shown in FIGS. 10, 11) to achieve extension of length of the locator 6.

A plurality of projector lamps 9, as shown in FIGS. 1 and 2, which can be installed at specified positions to suit requirements by means of the electrical connecting device 8 installed at the end of each projector lamp 9, and choose which power supply circuit connection system 11 or 12 in the single track unit 1 to switch on or off the projector lamp 9;

The electrical connection device 8, as shown in FIGS. 13 through 16, the connector head 80 is shaped like a crescent, consisting of a casing unit 81 and a front panel 82 combined together, wherein the casing unit 81 provides an assembling space 83 to accommodate an electrical unit 84. At two sides of the electrical unit 84 are an upper and a lower clearance wherein there is respectively an embedding groove 841, 842, respectively providing an electrical insert plate 85, 86 and embedded connection for all power cords of the projector lamps 9. Located at the end of the casing unit 81 on the assembling space 83 is a penetrating assembling hole 811, assembled with a movable and rotatable snap fastener 87. The front panel 82 has a longitudinal panel side 821 and a horizontal panel side 822 that are combined as one unit. At the upper and lower new neighboring positions of the longitudinal panel side 82 are two through assembling holes 823, 824, respectively corresponding to the assembling hole 811 of the casing 81 and the assembling space 83, for extension and assembly of the snap fastener 87 and the electrical unit 84 and the electrical insert plates 85, 86. One side of the horizontal panel side 822 provides an embedding assembling groove 825 to embed and assemble a grounding electrode 88.

The two electrical insert plates 85, 86 and the grounding electrode 88 are made of conductive plates, each having an electrical end 851, 861, 881 and a connecting end 852, 862, 882, wherein when the electrical end 881 of the grounding electrode 88 is installed to correspond with the horizontal panel side 822 of the front panel 82, it is located on the upper side of the horizontal panel side 822, providing electrical connection for the joint electrode end 19 of the track unit 1. The electrical ends 851, 861 of the two electrical insert plates 85, 86 face forward and penetrate the through assembling hole 824 when installed at the electrical unit 84, the interval between the two electrical ends 851, 861 is equal to the clearance between openings 263 of the electrode unit 2 in the two track grooves 13, 14 of the track unit 1, the extended length is no shorter than the length required for electrical connection of the accommodating space 261 and the conductive unit 262 entering the opening 263, the thickness of the two electrical ends 851, 861 is preferably no smaller than the height of the opening 263. As for the connecting wire ends 852, 862, 882, on the ends are respectively a wire cut groove 853, 863, 883, with a groove width equivalent to the diameter of the metal filament of the power cord of the projector lamp 9, for direct electrical connection after cutting into the insulating coating of the power cord.

The snap fastener 87 inside the assembling hole 811 that is movably installed in the connector head 80 has a rotating block 871. The rotating block871 has a recess 872 on its surface. This recess 872 can be formed in various shapes, preferably in the shape of a straight line or a cross, to facilitate inserting a simple hand tool (such as a screwdriver) into the recess 872 to rotate it and adjust the direction of a fastening head 873 extending from one end of the rotating block 871, to correspond with the fastening groove 15 (shown in FIG. 14) inside the track unit 1, in coordination with the fastening and positioning of the reverse stop wall 152 (shown in FIG. 15). The fastening head 873 is shaped as a non-straight column, its end having a curved hook end 874, so as to facilitate entrance into the fastening groove 15 by rotating control of its direction, and for snap fastening of the reverse stop wall 152 under rotating control of direction.

The actual assembly and operation of the preferred embodiment of the invention is illustrated in FIGS. 1 through 16. Since the track unit 1 is flexible, it can be bent to suit the position on a wall side or a ceiling (shown in FIG. 1), enabling electrical connection of a required length from the extension member 4 to the track unit 1 (shown in FIGS. 4 and 5), with power supply of electrical connection provided by at least one set of power supply set 5 in combination with two power supply circuit connection system 11, 12 of the track unit 1 (shown in FIGS. 7 and 8), and according to the position where the track unit 1 is installed and its distance from the ceiling or the wall surface, the locator 6 is fixed onto the ceiling or the wall, with installation of the hanging post 65 of the locator 6 corresponding to the fastening of the installing groove 16 of the track unit 1 to hang the tack unit 1 (shown in FIGS. 10 and 11).

Under this structure of the track unit 1, the single track unit 1 can obtain two composite power supply circuit connection system 11, 12 and electrical connection assembling environment, and obtain more environmental space for the projector lamps 9, the electrical connection device 8 installed at the end of the projector lamp 9 correspond with the selected power supply circuit connection system 11 or 12 for assembly (shown in FIGS. 14 and 16), the electrical ends 851, 861 of the two electrical insert plates 85, 86 of the electrical connection device 8 correspond with the opening 263 of the electrode set 2 of the power supply circuit connection system 11 or 12 for selected insertion, at this point there is a relationship of clamping action between the two electrical insert plates 85, 86 and the opening 263, and the ends of the two electrical insert plates 85, 86 entering the accommodating space 261 and the conductive unit 262 for electrical connection, and the grounding electrode 88 of the horizontal panel side 822 of the electrical connection device 8 are connected electrically by means of the joint electrode end face 19 at the bottom of the track unit 1 corresponding with the electrical end 881 (shown in FIGS. 14 and 16), then a hand tool is used to rotate and move the fastening member 87 mounted in the fastening groove 15 of the track unit 1, so the fastening head 873 is driven by rotation direction control to correspond with the reverse stop wall 152 for fastening purpose (FIG. 15), so the electrical connecting device 8 is fastened in the track unit 1 and in electrical connection with the power supply circuit connection systme11 or 12, for respective installation of the projector lamps 9 in the two power supply circuit connection system 11, 12, dividing and defining the projector lamps into two on/off control groups, for respective on/off or simultaneous on/off control.

Furthermore, it is to be understood that the above description covering the preferred embodiment of the construction of the present invention shall not be based to limit or restrict the present invention in any form, therefore, all modifications or variations made without departing the spirit of the invention shall be included in the subject claim.

What is claimed is:

1. A track system of projector lamp and electrical connection device assembly thereof, comprising:

at least a track unit, an end side of a track seat being defined as a common electrode end side for grounding purpose, on two longitudinal end sides of the track seat respectively having a first power supply circuit connection system and a second power supply circuit connection system;

at least one projector lamp, having an electrical connection device at an end thereof;

an electrical connection device, at a front of a connector head being an extension of two electrode insert plates and a grounding electrode, for electrical connection with one selected power supply circuit connection system, in coordination with a snap fastener that can be rotated for drive and control to fasten a corresponding track unit in place;

what can be obtained under said single track unit structure includes two composite power supply circuit connection systems and an electrical connection assembling environment, providing more projector lamps with their ends installed with electrical connection devices, corresponding to a selected power supply circuit connection system, the electrical insert plates corresponding to the electrode set of the selected power supply circuit connection system for insertion and electrical connection, said grounding electrode being connected with a common electrode end side of the track unit, with the snap fastener fastened to a fastening groove, to obtain electrical connection device being fastened in the track unit, for electrical connection with a power supply circuit connection system, under the single track unit structure, these assembled plurality of projector lamps being respectively assembled to the two power supply circuit connection system, dividing and defining the projector lamps into two on/off control groups, for respective on/off control or simultaneous on/off control.

2. The track system of projector lamp and electrical connection device assembly thereof of claim 1, wherein the first power supply circuit connection system and the second power supply circuit connection system are respectively located at two longitudinal sides of the track seat in the track unit, the systems are respectively assembled facing each other in a half end side of the track seat, and respectively consisting of two track grooves and a fastening groove, in combination with the common electrode end side, meanwhile, in each track groove being respectively fastened and embedded an electrode set, serving as an medium for power transmission and connection.

3. The track system of projector lamp and electrical connection device assembly thereof of claim 2, wherein the electrode set embedded in the track groove comprises an insulating member, providing an accommodating space to assemble a conductive unit for power transmission, the accompanying space being communicative with a side end of an opening and the insulating member, providing a channel for electrical connection with the electrical insert plates of the electrical connection device.

4. The track system of projector lamp and electrical connection device assembly thereof of claim 3, wherein the insulating member of electrode set embedded in the track groove is made in an elongated shape of materials having insulating properties, the materials used being preferably foam products or other materials or finished products with insulating or separating functions.

5. The track system of projector lamp and electrical connection device assembly thereof of claim 2, wherein the fastening grooves in the first power supply circuit connection system and the second power supply circuit connection system are shaped to have a width of groove bottom larger than the groove channel, forming at least one side of reverse stop wail, preferably in the shape of a reversed "T".

6. The track system of projector lamp and electrical connection device assembly thereof of claim 1, wherein the bottom end side serving as a common electrode end can be a flat level bottom end side.

7. The track system of projector lamp and electrical connection device assembly thereof of claim 6, wherein the bottom end side serving as a common electrode end can be a recessed bottom end, so the grounding electrode of the electrical connection device when corresponding for electrical connection can provide snap fastening function, contributing to the solid installation and electrical connection of the projector lamps.

8. The track system of projector lamp and electrical connection device assembly thereof of claim 1, wherein at an end of the track seat of the track unit is an installing groove, providing assembly for the locator to position the track unit on a ceiling or a wall surface.

9. The track system of projector lamp and electrical connection device assembly thereof of claim 8, wherein the installing groove is preferably shaped to have a width of groove bottom larger than the groove channel, forming a reverse stop shoulder in the shape of a reversed "T".

10. The track system of projector lamp and electrical connection device assembly thereof of claim 8, wherein the locator assembly comprises an upper tightening block, at an bottom end being a tightening chamber with a thread, having a through hole running upward, for assembling the tightening member to penetrate and directly correspond with the ceiling or wall surface for fixed tightening and positioning; a hanging member, having a base, at its base being an extension of a hanging post, for hanging, fastening and assembling of the installing groove corresponding to the track unit, at an upper end of the base being a formation of a threaded connector head, for tightening and assembly of the tightening chamber corresponding to the upper tightening block, to install the track unit.

11. The track system of projector lamp and electrical connection device assembly thereof of claim 10, wherein the hanging post extending from the hanging member of the locator has a post head width larger than the post wall, with a shape symmetrical to the installing groove of the track unit.

12. The track system of projector lamp and electrical connection device assembly thereof of claim 10, wherein the assembled total length of the locator can be extended by at least one set of extension assembly, to suit the clearance from a ceiling or a wall surface and height of installation when the track unit is assembled.

13. The track system of projector lamp and electrical connection device assembly thereof of claim 12, wherein the extension assembly consists of an upper assembling block and a lower assembling block with a screw tightening set, a top end of the upper assembling block being shaped to have a threaded connector, corresponding to the assembly of a tightening chamber of the upper tightening block, at a bottom end of the lower assembling block being a treaded tightening chamber providing tightening and assembling for a connector of the hanging member, to obtain extension of length of the locator.

14. The track system of projector lamp and electrical connection device assembly thereof of claim 1, wherein the installation length of the track unit can be extended by an extension assembly to connect and obtain electrical connection.

15. The track system of projector lamp and electrical connection device assembly thereof of claim 1, wherein the extension assembly consists of two hemispheres that are combined and tightened by screws as one unit, forming coated extension and two neighboring track units in electrical connection, on an inside of the hemispheres being installed two partitioning plates in parallel arrangement with a clearance between, a space obtained between the partitioning plates providing a space required for combining and tightening the hemispheres, in each of the upper and lower clearances being respectively two groove openings, and at two neighboring groove openings on an inside end of the hemisphere being an embedding groove, to obtain better fastening of a conductive plate embedded between each groove opening and its neighboring embedding groove, for extension of power.

16. The track system of projector lamp and electrical connection device assembly thereof of claim 15, wherein the partitioning plate formed inside the hemispheres of the extension assembly is positioned to define the depth of penetration of the track unit into the extension member for assembling and positioning on the innermost side.

17. The track system of projector lamp and electrical connection device assembly thereof of claim 15, wherein a distance between two groove openings at an end side of the partitioning plates of the extension assembly is equivalent to the clearance between the track grooves of the track unit.

18. The track system of projector lamp and electrical connection device assembly thereof of claim 15, wherein the conductive plate of the extension assembly embedded between the groove opening and the embedding grooves has an elongated shape, the thickness of the conductive plate being equal to or slightly larger than the height of the opening of the insulating member, the width of the conductive plate being designed to enable its passage through the opening into the accommodating space for electrical connection with the conductive unit, serving as a medium of electrical transmission between extended track units.

19. The track system of projector lamp and electrical connection device assembly thereof of claim 1, wherein the power supply of the first power supply circuit connection system and the second power supply circuit connection system of the track unit are in electrical connection by means of at least one set of power supply set corresponding with two power supply circuit connection systems, this power supply set is fastened to a ceiling or a wall surface, in electrical connection with indoor power source to obtain power supply, and can be directly connected or through indoor lines to the control member for on/off control operation, the quantity of this control member can be equivalent to that of the power supply circuit connection system for respective connection and control.

20. The track system of projector lamp and electrical connection device assembly thereof of claim 19, wherein the power supply set comprises a power disc, the power disc is extended and connected by means of conductive wire to at least one electrical connection member, that is, in consideration of driving control and installation, two power supply sets can be adopted for respective electrical connection with a power supply circuit connection system.

21. The track system of projector lamp and electrical connection device assembly thereof of claim 20, wherein the power disc of the power supply set can have two or more sets of electrical connecting members, simultaneously in connection to two power supply circuit connection systems of two or more track units for electrical connection.

22. The track system of projector lamp and electrical connection device assembly thereof of claim 20, wherein the electrical connection member of the power supply set can be an electrical connection device that is installed at an end of the projector lamp, or other type of electrical connecting member.

23. The track system of projector lamp and electrical connection device assembly thereof of claim 20, wherein the electrical connection member of the power supply set can be shaped like a plug, for direct insertion of an end of track unit in the accommodating space of the electrode set corresponding to respective track groove.

24. The track system of projector lamp and electrical connection device assembly thereof of claim 1, wherein the electrical connection device includes a connector head, preferably shaped like a crescent, consisting of a casing seat and a front panel combined as one unit, the casing seat providing a set of assembling space to embed an electrical seat, in an upper and a lower clearance on two sides of the electrical seat is respectively an embedding groove, respectively providing embedded connection of an electrical insert plate and the power cord of each projector lamp, at a casing seat end above the assembling space is an assembling hole running through, to assemble a snap fastener that is movable and rotatable; the front panel has a longitudinal panel and a horizontal panel combined as one unit, on the longitudinal panel and located in upper and lower neighboring positions being two assembling holes, respectively corresponding to the assembling hole and the assembling space of the casing seat, to facilitate extended assembly of two electrical insert plates assembled at the snap fastener and the electrical seat, one side of the horizontal panel providing an embedding groove to embed the grounding electrode.

25. The track system of projector lamp and electrical connection device assembly thereof of claim 24, wherein the electrical insert plates and grounding electrode of the electrical connection device are made of conductive metal plates, each having an electrical end and a connecting end.

26. The track system of projector lamp and electrical connection device assembly thereof of claim 24, wherein the electrical end of the grounding electrode of the electrical connection device is located above the horizontal panel when embedded to correspond to the horizontal panel of the front panel, for electrical connection with the common electrode end of the t rack unit.

27. The track system of projector lamp and electrical connection device assembly thereof of claim 24, wherein the electrical end of the electrical insert plate in the electrical connection device faces forward to penetrate the assembling hole when assembled to the electrical seat, the clearance between the electrical ends equal to the clearance between the openings of the electrode sets in the two track grooves of the track unit, its extended length is preferably no shorter than the length required for passage through the opening and into the accommodating space and the conductive unit for electrical connection, the thickness of the two electrical ends preferably no smaller than the height of the opening.

28. The track system of projector lamp and electrical connection device assembly thereof of claim 24, wherein the snap fastener that is movably assembled in the assembling hole of the connector head has a rotating block, on the rotating block being a recess, the recess is in various shapes, but preferably in a straight line or a cross, extending from one end of the rotating block being a fastening head to correspond to the fastening groove mounted in the track unit, coordinating with the reverse stop wall for assembly and positioning, the fastening head being shaped as a non-straight column having a curved hook end at one end thereof.

29. The track system of projector lamp and electrical connection device assembly thereof of claim 1, wherein the track seat of the track unit is, but not limited to, an elongated rail, preferably having conductivity, made of copper, iron, aluminum, silver or other conductive metal materials or materials plated with gold, copper, iron, aluminum, silver or other conductive metal materials, preferably aluminum materials extruded as aluminum products, to have appropriate connection and grounding function to reduce the weight and cost of the track unit.

* * * * *